US005638913A

United States Patent [19]

Blum

[11] Patent Number: 5,638,913

[45] Date of Patent: Jun. 17, 1997

[54] ADJUSTABLE HEIGHT STEP-ON CONTAINER

[76] Inventor: Alvin S. Blum, 2350 Del Mar Pl., Ft. Lauderdale, Fla. 33301

[21] Appl. No.: 380,394

[22] Filed: Jan. 30, 1995

[51] Int. Cl.[6] ..... A47B 9/12

[52] U.S. Cl. ..... 182/33; 182/222; 248/188.2

[58] Field of Search ..... 182/33, 178, 35, 182/222; 297/461, 462, 423.45, 423.41, 423.39; 482/52; 108/146; 248/188.2

[56] References Cited

U.S. PATENT DOCUMENTS

| | | | |
|---|---|---|---|
| 720,776 | 2/1903 | Bennett | 108/146 |
| 949,459 | 2/1910 | Bain | 108/146 |
| 2,509,525 | 5/1950 | Reichhelm | 296/462 |
| 2,770,293 | 11/1956 | Eichorst | 297/462 |
| 3,407,899 | 10/1968 | Delafrange | 182/20 |
| 3,536,359 | 10/1970 | Amos | 297/462 |
| 3,865,050 | 2/1975 | Cechetti | 108/19 |
| 4,292,903 | 10/1981 | Hockema | 297/462 |
| 4,471,969 | 9/1984 | Zabala | 280/30 |
| 5,050,861 | 9/1991 | Thomas | 272/70 |
| 5,176,596 | 1/1993 | Ullman | 482/52 |

*Primary Examiner*—Alvin C. Chin-Shue
*Attorney, Agent, or Firm*—Alvin S. Blum

[57] ABSTRACT

A portable container device for carrying various items such as tools, instruments and photographic equipment has a flat top or cover strong enough to provide an elevated platform for a user. To raise the user even more when required, the device is provided with an extending mechanism to raise the entire container even more above a support surface. The device has at least two configurations, a compact configuration when the lifting mechanism is withdrawn and a raised configuration when the lifting mechanism is extended. The raising or lifting mechanism may take the form of a sleeve surrounding the container or extendable legs that withdraw into the container.

9 Claims, 1 Drawing Sheet

FIG. 1
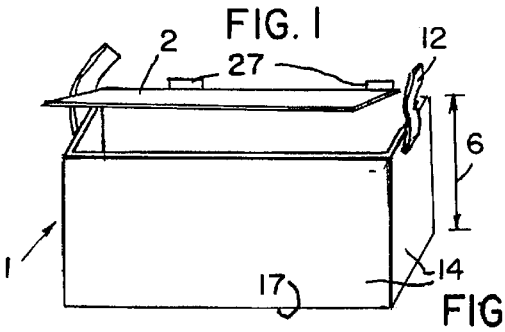
FIG. 2
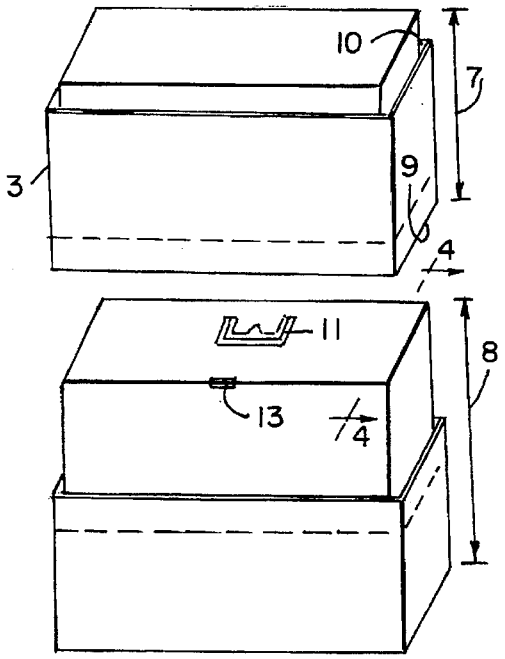
FIG. 3
FIG. 6
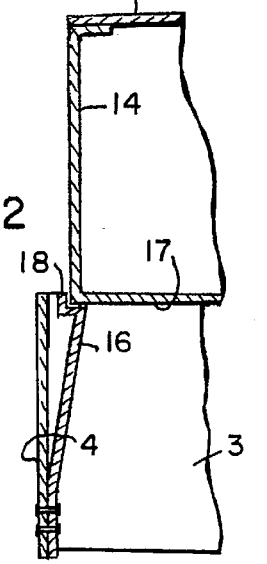
FIG. 5
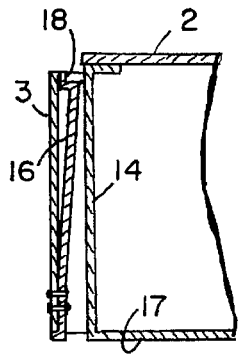
FIG. 4
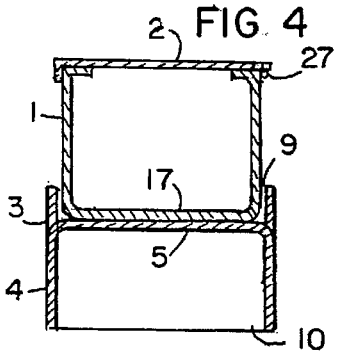
FIG. 8
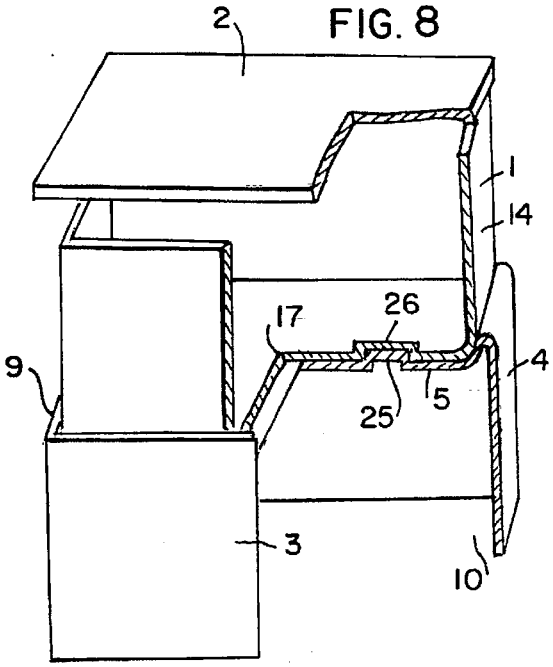
FIG. 7
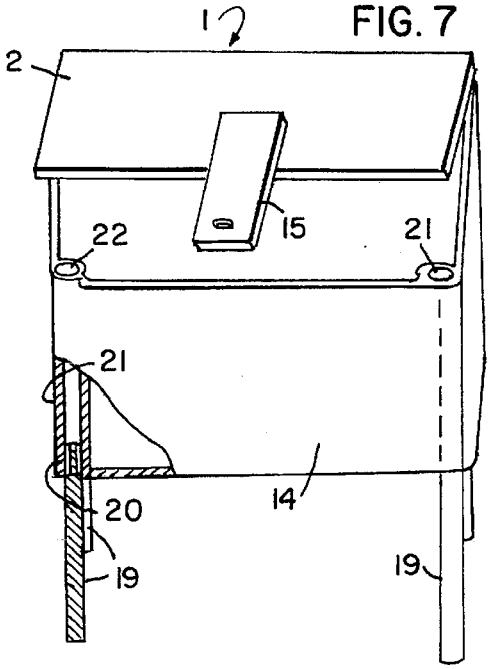

ADJUSTABLE HEIGHT STEP-ON CONTAINER

This invention relates to portable containers and more particularly to a portable container for carrying about tools, equipment and the like constructed to permit a user to stand thereon to elevate the user by the height of the container along with means for adjustably further elevating the user.

BACKGROUND OF THE INVENTION

Workers such as carpenters, and photographers generally carry the tools of their trade in a toolbox or camera bag to the workplace. They often find it necessary to stand on something to elevate themselves by one or two feet to reach a workpiece or photograph over a crowd. They may find it necessary to carry along a small stepladder rather than rely upon some dangerous substitute for this purpose. They are then burdened with two cumbersome items to carry about. If the toolbox could somehow also serve as the stepladder without making it too awkward to use effectively, it would greatly simplify the workplace, especially for a short worker.

SUMMARY OF THE INVENTION

It is accordingly an object of the invention to provide a container upon which a worker can safely stand for elevation. It is another object that the container be adjustable to provide yet another additional stable elevation greater than the box height.

The container of the invention has a rigid top strong enough to stand upon. The top is supported by sufficiently strong vertical elements to support the weight of the user. A removable sleeve element has rigid sides which encircle the container sides and is open at both ends. A transverse partition within the sleeve is close to one open end. When the box or container is inserted into the sleeve with the partition close to the top of the sleeve, the box is elevated considerably so that the worker in effect is up two steps, the height of the box and the height of the lower portion of the sleeve. When the sleeve is reversed, the box fits into the sleeve for a reduced height convenient for transporting and when the extra height is not required.

In an alternative embodiment, the partition is replaced by a catch mechanism within the sleeve to hold the box in the elevated position.

In yet another embodiment of the invention, extension legs are carried within the box, and these legs are adapted to be removably attached to the box to elevate the box upon the legs for further elevation.

These and other objects, advantages and features of the invention will become more apparent when the detailed description is considered in conjunction with the drawings.

BRIEF DESCRIPTION OF THE DRAWINGS

FIG. 1 is a perspective view of a box of the invention without the sleeve.

FIG. 2 is a perspective view of a box of the invention with sleeve in the low configuration.

FIG. 3 is a perspective view of the box of FIG. 2 with the sleeve in the high configuration.

FIG. 4 is a sectional view taken through line 4—4 of FIG. 3.

FIG. 5 is a partial sectional view of another embodiment of the invention in low configuration.

FIG. 6 is a partial sectional view of the embodiment of FIG. 5 in the high configuration.

FIG. 7 is a perspective view, partially cut away, of another embodiment of the invention.

FIG. 8 is a perspective view, partially cut away, of another embodiment of the invention.

DETAILED DESCRIPTION OF PREFERRED EMBODIMENTS

Referring now to the drawings, in which identical or corresponding parts are indicated by the same reference character throughout the several views and first to FIGS. 1–4, a rigid box 1 has a hinged cover 2 attached by hinges 27, sufficiently strong to support a user standing thereon when closed. A carrying handle 11 may be recessed into the cover to present an unobstructed standing platform. A suitable latching or locking mechanism 13 may be provided to hold the cover closed when lifted by the handle. A carrying strap 12 may also be provided as is well known in the art. The vertical sides 14 of the box have sufficient strength to support the cover 2 when a user stands thereon. This supplies an unobstructed raised work platform that accompanies a worker with his container. A removable sleeve assembly 3 has rigid sides 4 which encircle the box and a transverse partition 5 closer to one open end 9 than the other open end 10. The box may be used alone without the sleeve assembly 3 to provide the height 6. With the sleeve in position as in FIG. 2, a second, greater height 7 is provided and the sleeve and box may be carried about in this compact form. With the sleeve in position as in FIG. 3, the greatest height 8 is provided. The partition 5 and the sleeve sides 4 must be strong enough to support the user, but they may have various configurations. They are shown here with uniform thickness walls, but they may have perforations, and various thicknesses as desired. Various well known catches, latches and fasteners may be provided to hold the sleeve and box together by means which need not be detailed herein. When a worker knows that the extra height will not be required, the box may be carried to the job site without the sleeve. Carrying the sleeve along with the box as in FIG. 2 in the compact configuration is not very difficult and is much less awkward than carrying a small stepladder while actually providing more stability due to the larger platform.

Referring now to FIGS. 5 and 6, the sleeve assembly 3 has the vertical sides 4, but not the transverse partition. Instead, a spring latching mechanism 16, which engages the bottom 17, holds the box in the elevated position shown in FIG. 6. To provide the compact configuration, the sleeve 3 slides onto the box from the top, and the sides of the box force the spring 16 outwardly against the spring bias to permit the sleeve 3 to be held in position along the sides of the box. When the sleeve height is less than the box height, the overall height of box with sleeve in compact configuration is no greater than the box alone, and the spring action of the spring 16 holds the sleeve in place. The spring 16, has a stop 18 which limits its travel beneath the box, so that the box is held up at its edge and the forces on the spring member 16 are almost vertical. The spring member 16 may extend slightly below the wall 4 of the sleeve so that it rests upon any support surface. This takes pressure off the sleeve sides 4. They do not need to be as strong, since the spring element 16 then becomes the supporting member.

In the alternative embodiment shown in FIG. 7, the box 1 is provided with removable screw-on legs 19 that screw into female threads 20 in tubes 21 which form the corners 22 of the box. When unscrewed, the legs slide into the tubes from the top and are secured by the closed cover 2. Although screw threads are shown, other attaching means well known in the art may be employed as well. Because the legs 19 transmit force to the tubes 21 upon which the cover 2 rests, the principal support may be provided by these elements and the sides and bottom of the box need not be as sturdy. A disadvantage of this extending legs embodiment is that others may trip over the legs while the user is on the box. Removably attached to the cover 2 is a strut 15 which extends beyond the box. This serves as a support for a vertical element such as a photographer's monopod. It may be held in place by fastener means well known in the art, such as a hook and loop fastener with another on the underside of cover 2 for storage when not in use.

Referring now to FIG. 8, the sleeve assembly 3 may alternatively be provided with a partition 5 which closes off one end 9, while the other end 10 remains open. The partition 5 may extend straight across, or be provided with the indentation 24 shown here to ensure correct positioning of the container thereon. Snap together buttons 25 and recesses 26 are shown as removable fastening means.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A self-contained portable stand-on container assembly for carrying items about and for selectively supporting a person at first and second elevations above a supporting surface, the assembly comprising:

a box having a bottom, sides extending upward from the bottom, and a rigid closable and openable top hingedly affixed to the sides, the top having a substantially flat upper surface providing a stand-on platform with sufficient strength to support the weight of the person thereon at the first elevation above the supporting surface when the bottom is resting upon the supporting surface;

a sleeve means for encircling the sides and for removably attaching to the box for carrying the assembly about in a compact mode of operation in combination with a handle attached to the assembly, the sleeve means having side walls with first and second ends defining an interior space; and bottom engaging means attached to the side walls and disposed within the interior space intermediate the first and second ends and closer to the first end, the bottom engaging means for engaging and supporting the bottom in an extended mode of operation for elevating the top to the second elevation above the supporting surface when the second end is resting upon the supporting surface and the first end encircles the sides, the second elevation being at least 50 percent greater than the first elevation.

2. The assembly according to claim 1 in which the sleeve means is adapted to be reversible so that the first end is lowermost in the compact mode and the second end is lowermost in the extended mode.

3. The assembly according to claim 2 in which the bottom engaging means comprises a fixed transverse member.

4. The assembly according to claim 3 in which the top is supported at a third elevation intermediate the first and second elevations when the assembly is in the compact configuration, the first end is resting upon the supporting surface, and the second end encloses the box.

5. The assembly according to claim 1 in which the bottom engaging means comprises a plurality of resilient elements attached to the side walls and adapted to springably yield to passage of the box in a first direction and to resist passage of the box in a second direction so as to engage and support the bottom for the extended configuration.

6. A self-contained portable stand-on container assembly for carrying items about and for selectively supporting a person at first, second and third elevations above a supporting surface, the assembly comprising:

a box having a bottom, sides extending upward from the bottom, and a rigid closable and openable top hingedly affixed to the sides, the top having a substantially flat upper surface providing a stand-on platform with sufficient strength to support the weight of the person thereon at the first elevation above the supporting surface when the bottom is resting upon the supporting surface;

sleeve means for telescopically enclosing the sides and for removably attaching to the box for carrying the assembly about in a compact mode of operation in combination with a handle attached to the assembly, the sleeve means having side walls with first and second ends defining an interior space;

a transverse member attached to the side walls and disposed within the interior space intermediate the two ends and closer to the first end, the transverse member adapted to engage and support the bottom with the first end uppermost and encircling the sides and the second end resting upon the supporting surface to support the top at the second elevation above the supporting surface in an extended mode of operation and the transverse member adapted to engage and support the bottom with the second end uppermost and encircling the sides and the first end resting upon the supporting surface to support the top at the third elevation above the supporting surface in the compact mode of operation, the second elevation being at least 50 percent greater than the first elevation and the third elevation being intermediate the first and second elevations.

7. The container assembly according to claim 6 further comprising a recess in the top for receiving the handle.

8. A self-contained portable stand-on container assembly for carrying items about and for selectively supporting a person at first and second elevations above a supporting surface, the assembly comprising:

a box having a bottom, sides extending upward from the bottom, and a rigid closable and openable top hingedly affixed to the sides, the top having a substantially flat upper surface for providing a stand-on platform with sufficient strength to support the weight of the person whereon at the first elevation above the supporting surface when the bottom is resting upon the supporting surface;

a sleeve means for telescopically enclosing the sides and for removably attaching To the box for carrying the assembly about in a compact mode of operation in combination with a handle attached to the box, the sleeve means having side walls with first and second ends defining an interior surface;

a plurality of bottom engaging and supporting elements within the interior space springably attached to the side walls and adapted to springably yield to passage of the box through the sleeve means in a first direction and to resist passage of the box in a second direction so as to engage and support the bottom close to the first end when the second end is resting upon the supporting surface to support the person at the second elevation above the supporting surface in an extended mode of operation, the bottom engaging and supporting elements springably holding the sleeve means against the box with the first end uppermost and adjacent the top in the compact mode of operation, the second elevation being at least 50 percent greater than the first elevation.

9. The container assembly according to claim 8 further comprising a recess in the top for receiving the handle.

* * * * *